US011808282B1

(12) United States Patent
Johar et al.

(10) Patent No.: US 11,808,282 B1
(45) Date of Patent: Nov. 7, 2023

(54) PROPELLER FAN ASSEMBLY WITH SILENCER SEEDS AND CONCENTRIC HUB AND METHOD OF USE

(71) Applicant: AAON, Inc., Tulsa, OK (US)

(72) Inventors: Chaitanya Johar, Tulsa, OK (US); Brent Stockton, Broken Arrow, OK (US); Rudy Powell, Skiatook, OK (US); Ariel Leff, Tulsa, OK (US)

(73) Assignee: AAON, Inc., Tulsa, OK (US)

( * ) Notice: Subject to any disclaimer, the term of this patent is extended or adjusted under 35 U.S.C. 154(b) by 0 days.

(21) Appl. No.: 17/684,933

(22) Filed: Mar. 2, 2022

(51) Int. Cl.
*F04D 29/66* (2006.01)
*F04D 29/64* (2006.01)
*F04D 19/00* (2006.01)

(52) U.S. Cl.
CPC ..... *F04D 29/661* (2013.01); *F04D 19/002* (2013.01); *F04D 29/644* (2013.01)

(58) Field of Classification Search
CPC ..... F04D 29/661; F04D 19/002; F04D 29/644
USPC ..... 415/119
See application file for complete search history.

(56) References Cited

U.S. PATENT DOCUMENTS

| | | | |
|---|---|---|---|
| 2,378,049 | A | 6/1945 | Upson |
| 3,911,064 | A | 10/1975 | McWhirter et al. |
| 4,869,644 | A | 9/1989 | Takigawa |
| 6,126,395 | A | 10/2000 | Shingai |
| 6,729,846 | B1 | 5/2004 | Wobben |
| 7,083,386 | B2 | 8/2006 | Horng et al. |
| 8,240,996 | B2 | 8/2012 | Surls |
| 8,596,984 | B2 | 12/2013 | Bessho et al. |
| 8,668,458 | B2 | 3/2014 | Cho et al. |
| 10,539,157 | B2 | 1/2020 | Schilling et al. |
| 2011/0150665 | A1 | 6/2011 | Eisenhower |

(Continued)

FOREIGN PATENT DOCUMENTS

| | | |
|---|---|---|
| CN | 1590778 | 3/2005 |
| CN | 201671881 | 12/2010 |

(Continued)

OTHER PUBLICATIONS

SXT—The Next Generation of Ultra-Low Noise Fans, https://www.howden.com/en-gb/products/fans/cooling-fan/cooling-fan-sxt-blade.

(Continued)

*Primary Examiner* — Yi-Kai Wang
(74) *Attorney, Agent, or Firm* — Margaret S. Millikin

(57) ABSTRACT

A propeller fan assembly that generates lower sound pressure during operation and minimizes blade deflection without sacrificing performance. The blades of the propeller fan comprise silencer seeds located on the suction side of the blades, closer to the leading edge and the tip of the blades. The silencer seeds are sized in increasing face area and form an array with areas increasing with each row. The propeller fan assembly also comprises a dual hub comprising more than one circumferential layer concentric with the axial fan's hub. Multiple circumferential layers provide significant additional support to the blades during operation. This minimizes blade deflection and preserves the performance of the blade as intended. The overall fan and orifice assembly uses a unique assembly method that allows for wide flexibility and permits use of motors of different types and sizes seamlessly with this propeller fan assembly.

41 Claims, 15 Drawing Sheets

(56) References Cited

U.S. PATENT DOCUMENTS

| | | | | |
|---|---|---|---|---|
| 2014/0147282 | A1 | 5/2014 | Hu et al. | |
| 2017/0184125 | A1* | 6/2017 | Matsui | F04D 29/661 |
| 2018/0003190 | A1* | 1/2018 | Hamada | F04D 29/38 |
| 2018/0080468 | A1* | 3/2018 | Kim | F04D 29/329 |
| 2018/0238343 | A1 | 8/2018 | Nakashima et al. | |
| 2019/0072105 | A1 | 3/2019 | Froh et al. | |

FOREIGN PATENT DOCUMENTS

| | | | | |
|---|---|---|---|---|
| CN | 203453123 | | 2/2014 | |
| CN | 204476859 | | 7/2015 | |
| CN | 206221361 | | 6/2017 | |
| CN | 107313979 | | 11/2017 | |
| CN | 107313979 | A * | 11/2017 | F04D 29/325 |
| CN | 111022371 | | 4/2020 | |
| CN | 210715260 | | 6/2020 | |
| EP | 0761980 | | 3/1997 | |
| EP | 2264321 | | 1/2019 | |
| EP | 3450717 | | 3/2019 | |
| JP | 2001090694 | | 4/2001 | |
| JP | 2003161295 | | 6/2003 | |
| JP | 200803760 | | 12/2008 | |
| JP | 2012154221 | | 8/2012 | |
| JP | 6129431 | | 5/2017 | |
| JP | 6604981 | | 11/2019 | |
| KR | 20110075290 | | 7/2011 | |
| KR | 20110131466 | | 12/2011 | |
| KR | 101392610 | | 5/2014 | |
| KR | 20140136180 | | 11/2014 | |
| KR | 101504743 | | 3/2015 | |
| KR | 200481153 | | 8/2016 | |
| TW | 348866 | | 1/2009 | |
| WO | 2019098604 | | 5/2019 | |

OTHER PUBLICATIONS

Biedermann, Till, "Aerofoil noise subjected to leading edge serration: Investigation of the Effects of Serrated Undulation on Aerofoil Leading Edges with the Aim of Reducing the Emission of Broadband Noise", (Sep. 2015), http://stroemungsakustik.de/old.mv.fh-duesseldorf.de/d_pers/Kameier_Frank/a_abschlussarbeiten/MasterThesis_Online_Biedermann_20150918.pdf.

Nine Inch Clockwise Fan Blade, (2017),https://www.indiamart.com/proddetail/9-inch-clockwise-fan-blade-14429192655.html.

Observation of Whale's Fin—Inspiration of a Surprise Fan, (Jul. 15, 2009),https://www.forcetake.com/news-pro-20081216-4.php.

Corsini, Alessandro, "Leading Edge Bumps in Ventilation Fans", The American Society of Mechanical Engineers Digital Collection, (Nov. 14, 2013),https://asmedigitalcollection.asme.org/GT/proceedings-abstract/GT2013/55188/V004T10A007/247355.

Corsini, Alessandro, "On the Role of Leading-Edge Bumps in the Control of Stall Onset in Axial Fan Blades", The American Society of Mechanical Engineers Digital Collection, (Jun. 5, 2013),https://asmedigitalcollection.asme.org/fluidsengineering/article-abstract/135/8/081104/374460.

Industrial Vehicle Technology International, (Apr. 20, 2020), https://www.ivtinternational.com/supplier-spotlight/multi-wing-international-a-s.

Noctua, (Nov. 5, 2013),https://www.mightyape.co.nz/product/140mm-noctua-nf-a15-flx-4-pin-round-case-fan/21723752.

Norman G. Clark, WindMaster Plastic Standard Fans, (Apr. 1, 2020),https://www.ngclark.com.au/brands/horton/fans/windmaster-plastic-standard-fans/.

Zalman, Zalman ZM-F2 Plus SF 92mm Shark Fin Blade Case Fan, (Jun. 15, 2014), https://www.quietpc.com/zm-f2-plus-sf.

* cited by examiner

PROPELLER FAN ASSEMBLY WITH SILENCER SEEDS AND CONCENTRIC HUB AND METHOD OF USE

TECHNICAL FIELD OF THE INVENTION

The present invention relates generally to propeller fan assemblies and, more particularly, but not by way of limitation, to axial propeller fan assemblies for heating, ventilation and air conditioning units. The present invention further relates to methods of using axial propeller fan assemblies.

SUMMARY OF THE INVENTION

The present invention is directed to a propeller fan for a heating, ventilation and air conditioning HVAC unit, the propeller fan comprising a plurality of blades arranged in a concentric configuration, each of the plurality of blades comprising a leading edge, trailing edge, a suction side and a discharge side; a plurality of protrusions P configured on the suction side proximate the leading edge of at least one of the plurality of blades; wherein the plurality of protrusions lowers sound pressure levels generated during operation of the propeller fan.

The present invention further is directed to a method of lowering sound pressure generation during operation of a heating, ventilation, and air conditioning system comprising a propeller fan having blades, the method comprising the steps of reducing dipole source strength as air passes over the blades during operation of the fan by providing a plurality of protrusions at a leading edge of a suction side of at least one of the blades.

A propeller fan for heating, ventilation, and air conditioning system unit, the propeller fan comprising a plurality of blades arranged in a concentric configuration around a central hub wherein the central hub comprises at least two circumferential layers and at least one connecting rib between the two circumferential layers.

The present invention is further directed to a method of a method of reducing deflection of blades of a propeller fan having a plurality of blades, the method comprising the steps of configuring the plurality of blades in a concentric configuration around a central hub wherein the central hub comprises at least two circumferential layers by providing a plurality of protrusions at a leading edge of a suction side of at least one of the blades.

The present invention is further directed to a modular mounting assembly for attaching different motor types and sizes to a propeller fan, the modular mounting assembly comprising: a sidewall; an inner ring forming a central annulus; a plurality of spokes extending between the sidewall and the inner ring; a motor connection forming a central aperture and positioned atop the inner ring; and a plate positioned above the motor connection, the plate forming a central aperture; wherein, when in assembled configuration, the central aperture of the plate aligns with the central aperture of the motor connection for receiving a motor.

The present invention further is directed to a heating, ventilation and air conditioning (HVAC) unit comprising: a propeller fan, comprising: a plurality of blades arranged in a concentric configuration, each of the plurality of blades comprising a leading edge, trailing edge, a suction side and a discharge side; and a plurality of protrusions P configured on the suction side proximate the leading edge of at least one of the plurality of blades; wherein the plurality of protrusions lowers sound pressure levels generated during operation of the propeller fan.

DETAILED DESCRIPTION OF THE INVENTION

Figure 1:
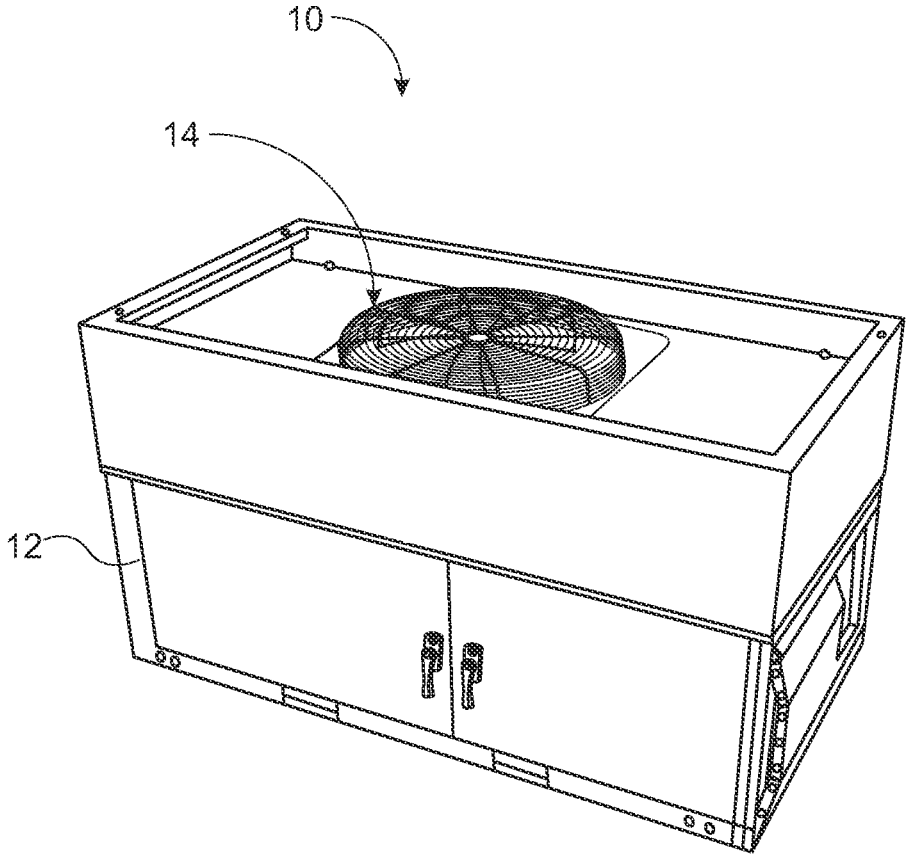
FIG. 1 is a perspective view a rooftop heating, ventilation and air conditioning unit.

A refrigeration system relies on a cyclical process to remove heat from the area or from the equipment that is being cooled and rejects the heat to the ambient surroundings, away from the cooled area. In many rooftop heating, ventilation and air conditioning ("HVAC") units, a condenser section has a heat exchanger coil containing the refrigerant that has been discharged from the compressor. To summarize the basic refrigeration cycle, heat is absorbed by refrigerant in an evaporator coil via warm air that flows through the coil and becomes cold in the process. From the evaporator, the refrigerant flows into the compressor as a low pressure vapor. The compressor adds pressure and temperature to the refrigerant ("heat of compression"). The refrigerant then flows into the condenser as a high pressure vapor. As the refrigerant, at this point, has a higher temperature and enthalpy than its surroundings, the condenser fan induces surrounding airflow to flow through the condenser coil, which transfers energy from the refrigerant to this airflow. Consequently, the refrigerant "dumps" heat to the surroundings while lowering its own enthalpy. The refrigerant then flows to an expansion valve as a high pressure liquid. The expansion valve is a pressure-reducing device and the high pressure liquid becomes a low pressure liquid. From here, the refrigerant flows into the evaporator coil, and the cycle repeats itself.

The cooling requirements for large retail, commercial and industrial scale processes sometimes separate the various components of the system for efficiency. In order for the refrigerant and the air to interact and exchange heat, an axial fan is commonly used in a refrigeration condensing section to force air to flow through the condenser coil. An axial fan is an air-moving device that causes a fluid to flow through the fan in a direction parallel to the axis of the fan rotation. Air passing through the condenser coil exchanges heat with the refrigerant that is flowing inside the condenser coil. The air gains enthalpy and becomes warmer, and the refrigerant loses this enthalpy after this air-refrigerant heat exchange. The refrigerant in the condenser coil thereby changes from a high pressure gas to a high pressure liquid after it flows through the condenser coil.

Fan selection and design are critically important for adequate delivery of the air and efficiency of the process. Airflow is important for many refrigeration systems as it is a medium for heat exchange, which is a critical process for an overall refrigeration system. The pattern of the air leaving the axial fan is impacted by multiple factors, including the position of the fan, the mounting orifice, the operating point, and the design features of the fan. The fan must have favorable acoustics and meet demands for reduction in noise pollution. As consumer demands heighten over time, lowering sound production from the fan is a key improvement. The fan must fit into the unit design constraints, and it must not have any kind of interference or collision with the surrounding parts during assembly and/or operation.

An axial fan may be designed to be HVLS (High Volume Low Static), meaning that the more important purpose of the axial condenser fan is to move a higher volume of airflow than to move air against a higher pressure. An axial fan assembly achieves at least two desirable characteristics, namely, it should be acoustically favorable, meaning the fan generates relatively less noise during operation, and it should not create interference issues during assembly or operation. The present invention achieves these goals and generates lesser sound pressure levels while operating at a desired favorable operating point, with respect to the air volumetric flow rate and static pressure.

The present invention achieves these goals at least in part through the provision of protrusions, or silencer seeds, strategically arrayed, shaped and sized, on the suction side proximate the leading edge of at least one blade of the fan. The location, arrangement, shape, sizes and surface area of these protrusions, or silencer seeds, on the suction side of the blades lowers sound generation. The evidence from the studies and tests is that these protrusions reduce sound pressure levels by as much as 3 dB, which is a significant difference, without altering the performance of the fan in terms of the volumetric flow rate of air at a particular static pressure. The invention has application in HVAC units, including space cooling, data center cooling, and industrial, commercial and residential cooling. The invention also presents a mounting mechanism for mounting the fan to the motor that enables the use and interchange of a variety of sizes and types of motors with the invention.

Further, the present invention minimizes blade deflection and preserves the performance of the blade as it was intended. Through advanced finite element-based computer simulations and physical verifications of models, it was found that a plastic fan that has two circumferential layers provided significant additional support to the blades during operation and minimizes blade deflection.

Turning now to the drawings, and to FIG. 1 in particular, there is shown therein a refrigeration rooftop unit 10, also referred to herein as a refrigeration unit or a unit. The unit 10 comprises a housing 12 and an axial propeller fan 14, also referred to herein as a propeller fan, a fan, or fan assembly, yet to be described. The refrigeration unit 10 also comprises an evaporator, an expansion valve, a compressor, a condenser, a receiver and a capacity control system, which are not depicted in FIG. 1. The evaporator removes the unwanted heat through refrigerant. The compressor draws low-temperature and low-pressure refrigerant from the evaporator through the suction line. The vapor is then compressed by the compressor causing a rise in the refrigerant's temperature and pressure. This high pressure vapor is discharged from the compressor and transferred into the condenser. The compressor adds enthalpy, or heat, into the refrigerant to make the refrigerant hotter than ambient surroundings in order to create a temperature gradient between the refrigerant and ambient air, thus allowing the refrigerant to dump heat to the cooler surroundings. One or more fans 14 placed near the condenser draw air over the condenser coil(s). The temperature of condensation for typical rooftop units will range between 20 to 30 degrees Fahrenheit above ambient surroundings, which typically comes to about around 95 to 130 degrees Fahrenheit. By releasing its heat via the condenser, the hot gas vapor is cooled until it becomes a high pressure liquid refrigerant again. The refrigerant then moves into the expansion valve, where there is a drop in the refrigerant pressure.

Figure 2:
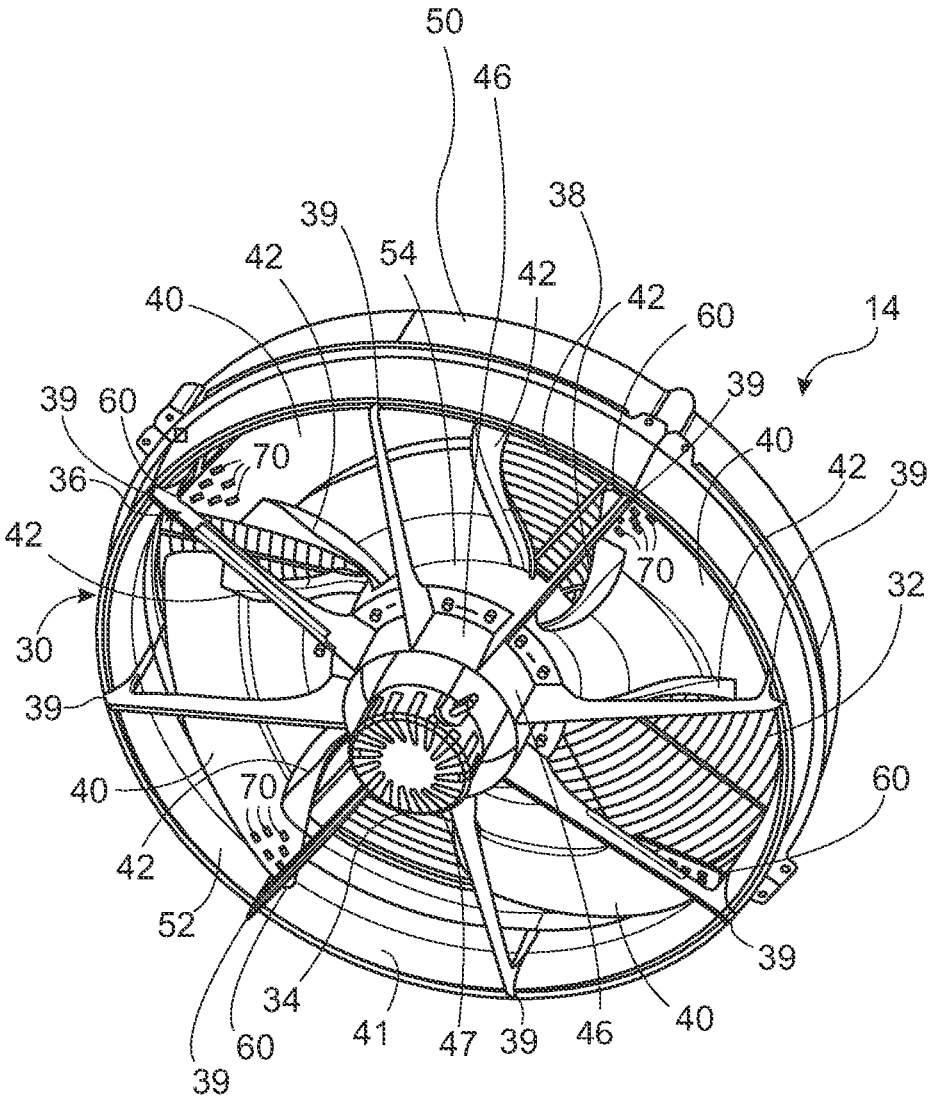
FIG. 2 is a perspective view of the suction side of an illustrative propeller fan assembly of the present invention.
Figure 3A:
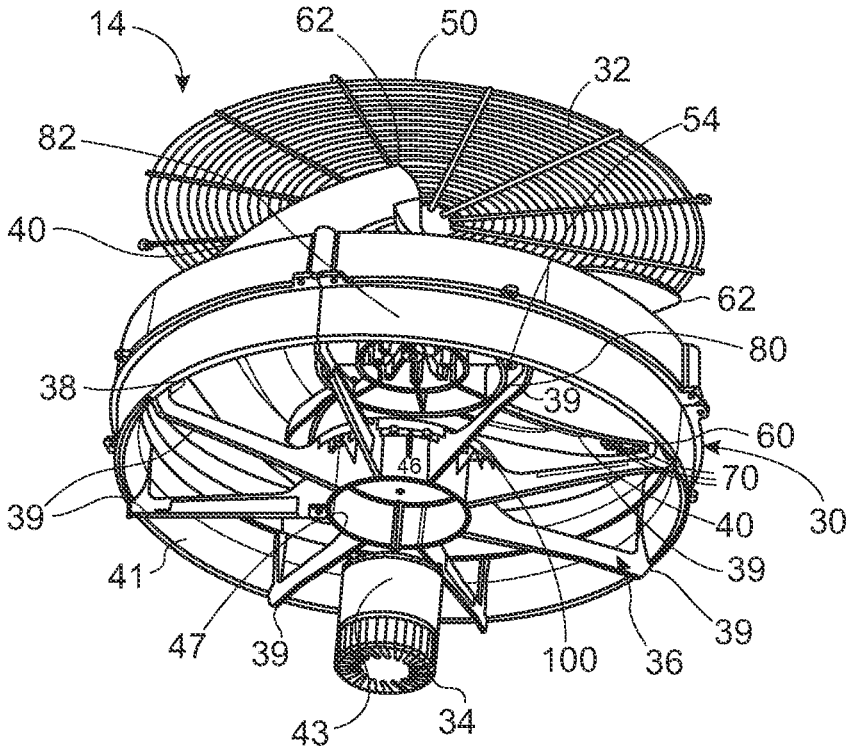
FIG. 3A is an exploded view of the propeller fan and mounting assembly of FIG. 2.
Figure 3B:
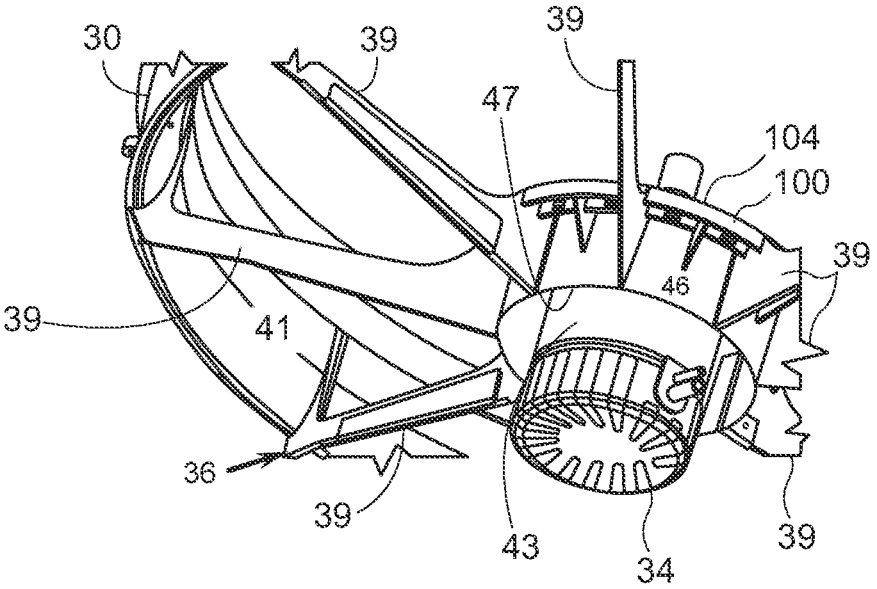
FIG. 3B is a perspective view partial view of an illustrative mounting assembly of the present invention showing an illustrative motor connection component.
Figure 3C:
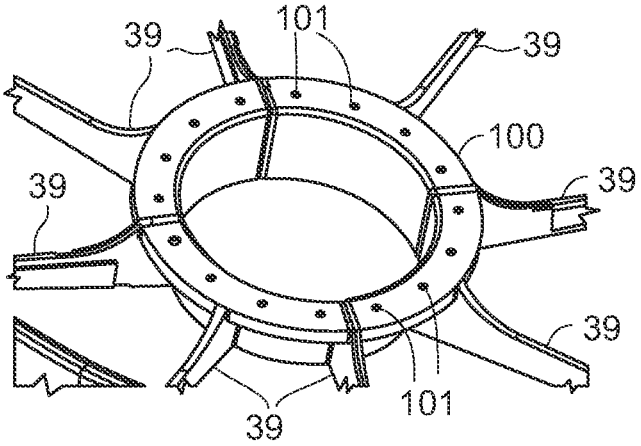
FIG. 3C illustrates a perspective view of a motor connection component.
Figure 3D:
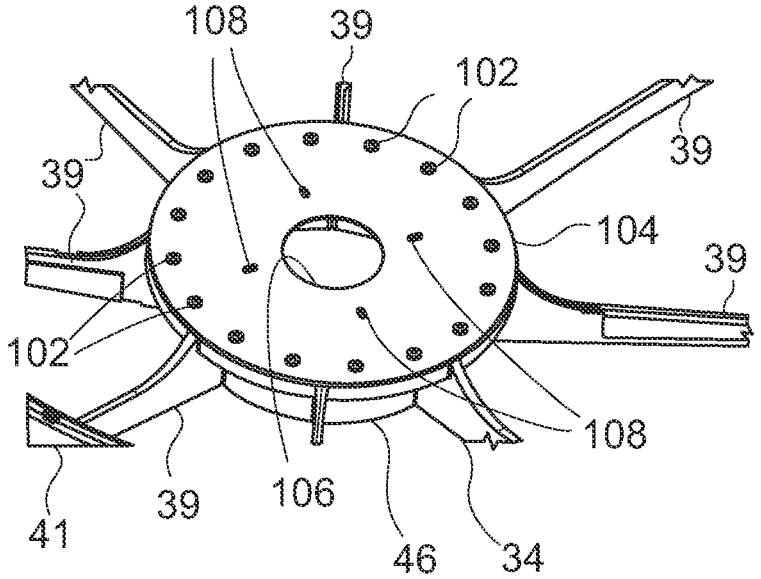
FIG. 3D illustrates a mounting plate which may be positioned above the motor connection component.

Turning now to FIGS. 2 and 3A, in one embodiment of the invention, the fan 14 comprises a frame 30, a grill 32, a motor 34, a motor mount 36 within a mounting orifice 38, and a plurality of blades 40. The frame 30 may be any shape and size suitable for the application. In one embodiment of the invention, the frame 30 is generally circular in shape. The frame 30 forms sidewalls 41 that are aerodynamically adapted to yield efficient air flow.

The mounting orifice 38 of the propeller fan 14 may range in diameter from about 5 inches (12.7 cm) to about 50 inches (127 cm). For efficiency, the diameter of the mounting orifice 38 is usually only minutely wider than the blades 40, which are mounted within the mounting orifice in a manner yet to be described, although it will be appreciated that greater clearances may be required for some applications. Therefore, the diameter of the frame 30 of the propeller fan 14 ranges from about 5.01 inches (12.73 cm) to about 50.01 inches (127.02 cm). In one embodiment of the invention, the propeller fan 14 is about 30 inches. References herein to diameters are to inside diameters, unless specifically stated to reference an outer diameter. It will be appreciated, however, that the fan 14 and the mounting orifice 38 may be any diameter, or length, width, or other dimension, suited for the application and the conditions at the site where in use.

The frame 30 may made be of any material suitable for use in refrigeration units, including steel, chrome, steel chrome-plated, steel with nickel/silicon carbide composite coating, brass, brass-chrome plated, brass with nickel/silicon carbide composite, stainless steel, stainless chrome-plated, stainless with nickel/silicon carbide composite coating, carbonitrided steel, nickel carbide plated steel, tempered steel, polyvinylchloride, and plastics, including polypropylene, and talc-filled polypropylene. It will be appreciated that the frame 30 may be produced from other materials suited to the particular temperatures, pressures, fluids and other conditions for the application and the site where the unit 10 is installed. In one embodiment of the invention, the frame is made with a talc-filled propylene plastic.

In one embodiment of the invention, the motor 34 is rated to output a certain horsepower, and the fan 14 is designed so that it will not pull any more power than the motor is designed to provide. The fan 14 must be able to move the desired airflow against a static pressure for which the unit 10 is designed. The motor 34 comprises a motor shaft 43 that, when in assembled configuration, penetrates an annulus 47 formed in the mounting assembly 36. The motor 34 is secured in place within the mounting assembly 36 via one or more setscrews (not shown), tightened onto the shaft.

The mounting assembly 36 comprises a plurality of spokes 39 that are integral with aerodynamically shaped sidewalls 41. The spokes 39 extend from the sidewalls 41 and conjoin at an inner wall 46 forming the annulus 47. These components may all be made of the same plastic material as the mounting assembly 36. The spokes 39 provide structural integrity, strength and stability to the mounting assembly 36 and the overall fan 14. The number of spokes 39 will vary with the size of the fan 14 and the application; however, in one embodiment of the invention, the mounting assembly 36 comprises eight spokes 39.

With continuing reference to FIG. 3A, but turning also to FIGS. 3B, 3C, 3D, 3E, 3F and 3G, an illustrative mounting assembly 36 for mounting the motor 34 to the frame 30 is described. The mounting assembly 36 comprises a motor connection component 100 secured atop inner ring 46 via screws 102. The motor connection component 100 may be made of the same materials as the frame 30 or may comprise a different material. A plate 104 is positioned above the inner ring 46 and is secured to the motor connection component 100 via screws 102 or other connection means through apertures 101. The plate 104 forms a central aperture 106 which aligns with the inner ring 46 and annulus 47 of the mounting assembly 36. In one embodiment of the invention, the plate 104 is made of metal, and a plurality of slots 108 are formed therethrough. The throughbolts (not shown) of the motor 34 protrude these strategically placed slots 108, situated generally centrally in the plate 104, and then a washer and nut (not shown) are added to these throughbolts, in order to create a bond between the motor 34 and the inner ring 46 of the mounting assembly 36 via the plate 104 and motor connection component 100. The plate 104 permits an enormous amount of flexibility in the ability to accommodate different motor styles and sizes and modularity in the motor 34.

Figure 3E:
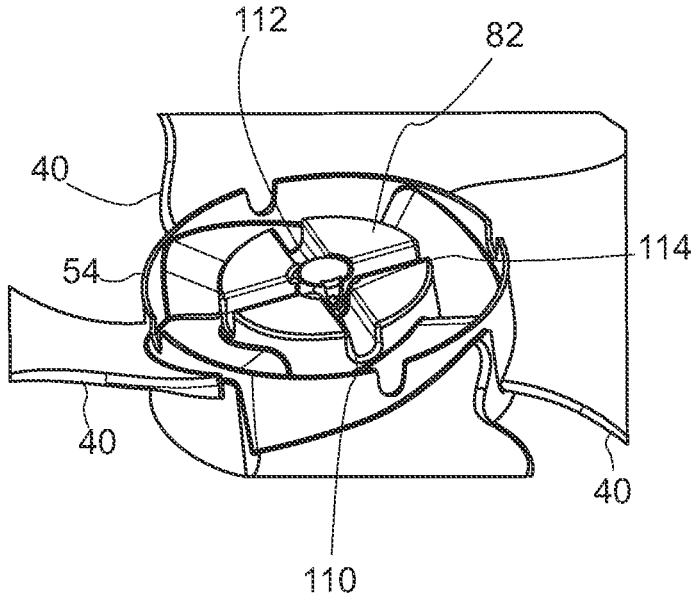
FIG. 3E illustrates an insert situated centrally in conjunction with central hub and the plurality of blades for connecting the blades with the motor shaft of the mounting assembly.
Figure 3F:
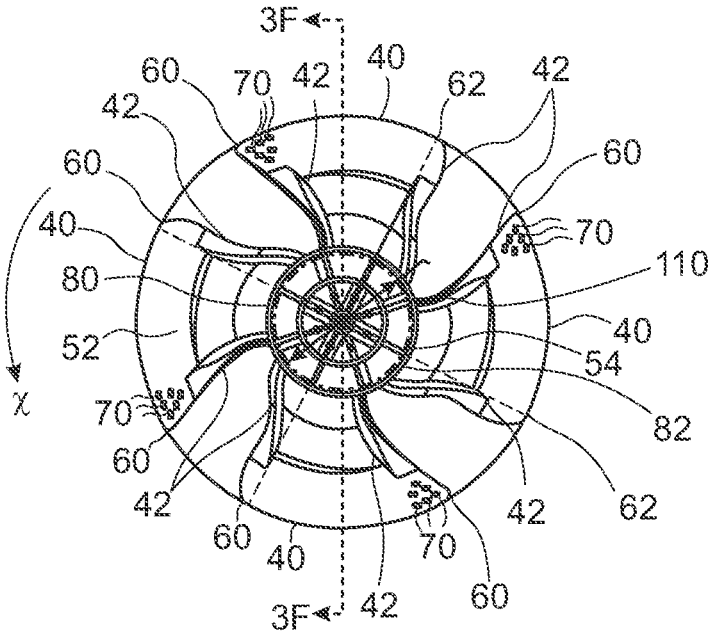
FIG. 3F shows a bottom plan view of the suction side of the plurality of blades and with the motor connection component and plate of the mounting assembly positioned within the central hub.
Figure 3G:
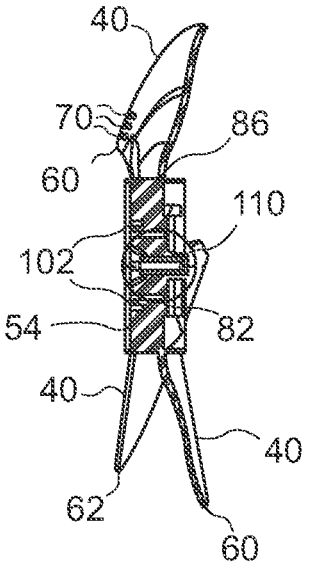
FIG. 3G is a cross-sectional view of the plurality of blades and the mounting assembly of FIG. 3F.

Returning now to FIGS. 2 and 3A, but with continuing reference to FIG. 3E, when in assembled configuration, the plurality of blades 40 are dropped into alignment with the motor shaft 43. An insert 110 is situated within the central hub 54 at closed top end 112 of the motor connection component 100. The motor shaft 43 forms a length that is customized to the application so that the plurality of blades 40 may be dropped on to the motor shaft 43 as far possible, or until the motor shaft hits the top end 112, which configuration facilitates manufacturing. A setscrew 114 is tightened on to the motor shaft 43, which secures the blades 40 to the motor shaft so that they rotate with the motor shaft.

A fan, by virtue of its rotational motion, creates a pressure differential that causes airflow to move from an area of high pressure to low pressure. To that end, the fan 14 comprises a top, or discharge side, 50 and a bottom, or suction side, 52. The fan 14 may be installed in any configuration within the refrigeration unit 10 although, in one embodiment of the invention, the fan 14 is installed in a rooftop refrigeration unit 10 in an orientation wherein the discharge side 50 faces the sky.

Figure 4:
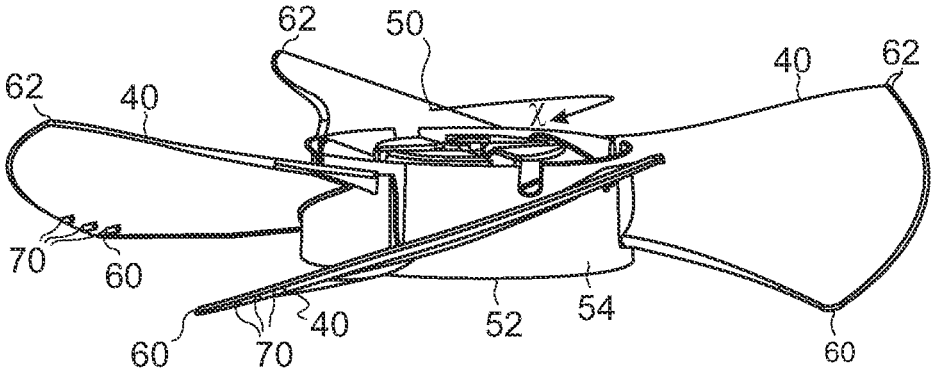
FIG. 4 is a side view of an illustrative propeller fan of the subject invention, showing the direction of rotation.

Turning now to FIG. 4, the fan 14, including the plurality of blades 40, which rotate in a direction x, and may be constructed from a wide array of materials, including plastics and metals. In one embodiment of the invention, the fan 14 and plurality of blades 40 are made from glass filled polypropylene or talc-filled polypropylene. The plurality of blades 40 are arranged centrifugally around a central hub 54 and may be formed integrally as a single unit or assembled from a group of components. In one embodiment of the invention, the blades 40 and the central hub 54 are fused as part of the same plastic injection mold. However, it is possible to separate the blades 40 from the central hub 54 and join them via male/female mates, welds, fasteners or some other style of bonding mechanism. In one embodiment of the invention, the fan 14 may be applied to a maximum speed of 1200 revolutions per minute (RPM) or more and may generate at least 7500 cubic feet per minute (CFM) when against a negative static pressure of 62 pascals (Pa) or other typical operating point.

The dimensions of the blades 40 vary according to application and the requirements at the site where the unit 10 is in use. In one embodiment of the invention, the largest circumscribed circle formed by the assembled blades 40 has a diameter of about 30 inches (761 mm), although it will be appreciated that this measurement will vary and may be smaller or larger.

The number of blades 40 comprising the plurality of blades will vary depending on the application and will be optimized for the application and the size of the unit 10. Increasing the number of in the plurality of blades 40 has potential to move more air but will also increase manufacturing costs and may consume more power. Additionally, if air is moved through a smaller diameter fan, the fan must be rotated at higher velocity to achieve the same flow. Therefore, the number of blades comprising the plurality of blades 40 will be optimized for the particular application, blade size, blade material, blade pitch, desired airflow, power consumption and the size of the unit 10. Having fewer blades or smaller blades may reduce drag but may also generate lesser airflow. Increasing blade size or the number of blades may not necessarily generate more airflow because of the larger drag. The increased drag requires a more powerful, energy-hungry and noisier motor. Additionally, having more blades adds weight to the fan and a more powerful motor may be needed to overcome the higher moment of inertia. Although it will be appreciated that the number of blades comprising the plurality blades 40 may be any number adapted for the particular application and size of the unit, in one embodiment of the invention, the number of blades comprising the plurality of blades 40 ranges is between two and six, and, in another embodiment of the invention, the number of blades equals four.

Figure 5:
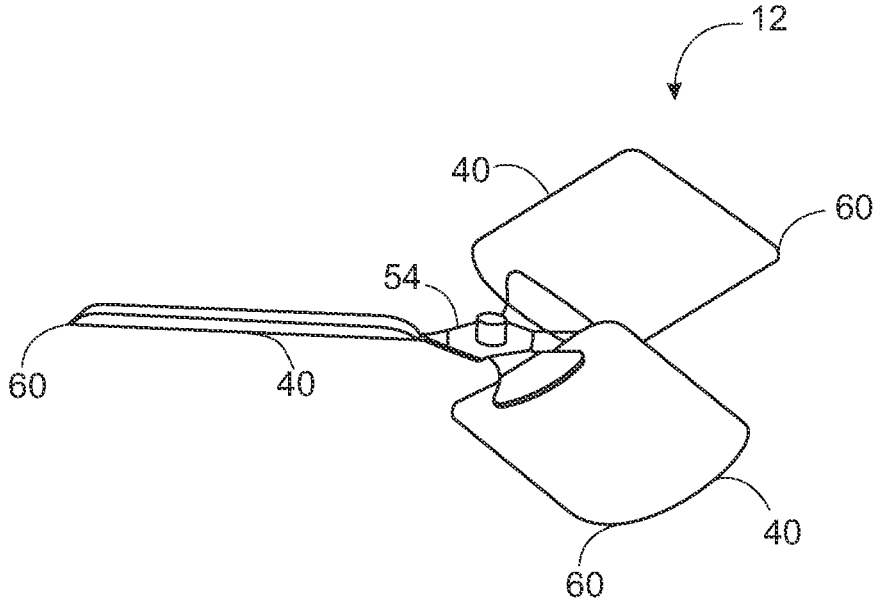
FIG. 5 shows an illustrative blade design comprising the propeller fan of the present invention.

Each of the plurality of blades 40 may comprise any shape adapted for the particular application and for the size of the unit 10. Conventional condenser fans may comprise a stamped metal blade, which may be of a relatively simple blade shape. One such geometry is illustrated in FIG. 5. As plastic injection molding technologies have progressed, it is now possible to design blades 40 with complex geometries to achieve favorable performance and other advantages. Computational fluid dynamics ("CFD"), which predicts how air flows over a blade, and finite element modelling ("FEA"), which predicts stresses and deformations of a blade, may be used to determine appropriate blade shapes and sizes for the plurality of blades 40 of the fan 14 of the unit 10 of the invention. These complex geometrical shapes offer more capability to design a fan 14 with more aerodynamic blades 40 that meet wider design requirements, generate lesser noise, function without part interference and/or collisions, and operate within the desired motor horsepower limitation.

Figure 6:
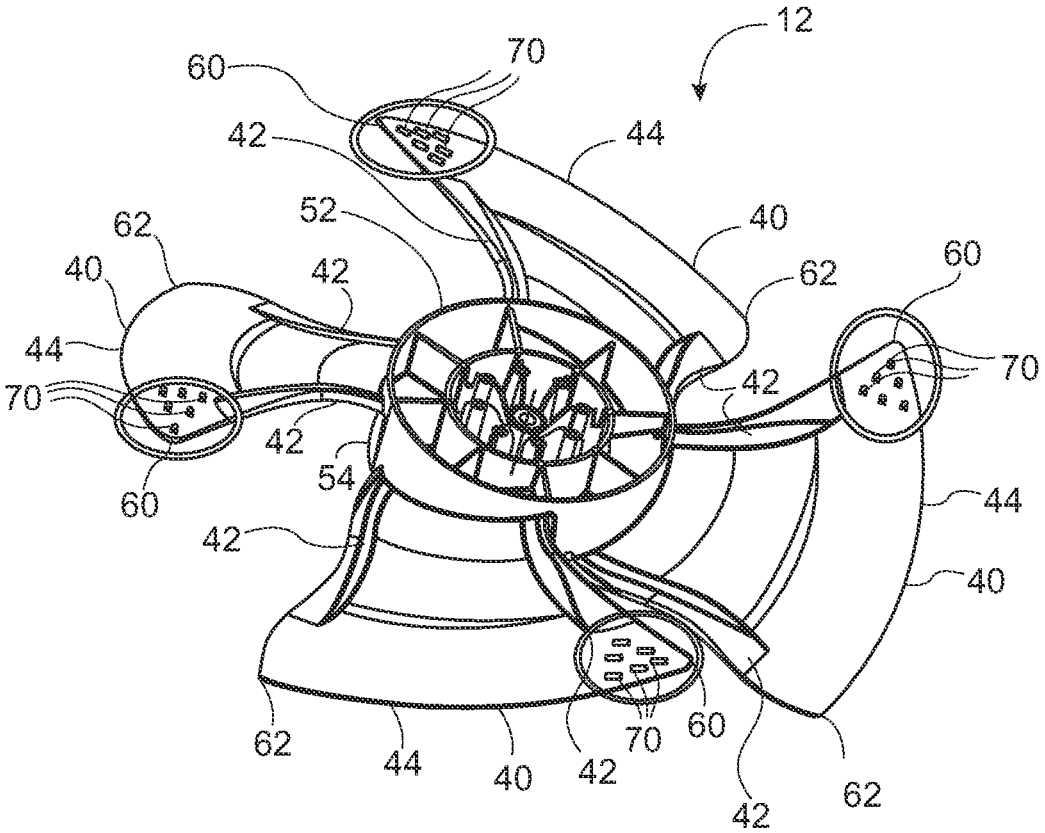
FIG. 6 shows an alternative illustrative blade design comprising the propeller fan of the present invention and illustrates placement of silencer seeds on the suction side the blades.

In one embodiment of the invention, the blades comprising the plurality of blades 40 have a complicated swept blade geometry, as shown by way of example, but without limitation, in FIG. 6. The plurality of blades 40 may be operationally configured centrifugally around the central hub 54 in a pitched or tilted arrangement. Each of the plurality of blades 40 forms a length between the central hub 54 and the edge 44 of the blade and may further comprise ribs 42 formed along a portion or all of the length therebetween to assist in preventing deflection of the blade. The pitch of the blades is one of the most important factors as far as how much power is consumed and how much flow is generated against a certain static pressure. The blade pitch is fine-tuned via CFD and FEA models. In one embodiment of the invention, the shape of the blades 40 generally may increase in diameter or in width as they extend axially from the central hub 54.

With continuing reference to FIG. 6, each one of the plurality of blades 40 forms a leading edge 60 and a trailing edge 62 at the end of the blade opposite the central hub 54. As the plurality of blades 40 rotate around the central hub 54, the leading edge 60 of each one of the plurality of blades 40 leads the blade in the direction of rotation x, while the edge on the opposite end of the blade distal the central hub is the trailing edge 62.

As previously mentioned, the fan 14 of the present invention achieves the dual goals of generating less noise during operation, or acoustic favorability, while minimizing or eliminating instances of interference during assembly and operation. Through CFD simulations, an axial fan has been designed that generates lower sound pressures while operating at favorable operating points, with respect to volumetric flow rate and static pressure. This CFD-based study has been physically validated in experimental test data.

Figure 7:
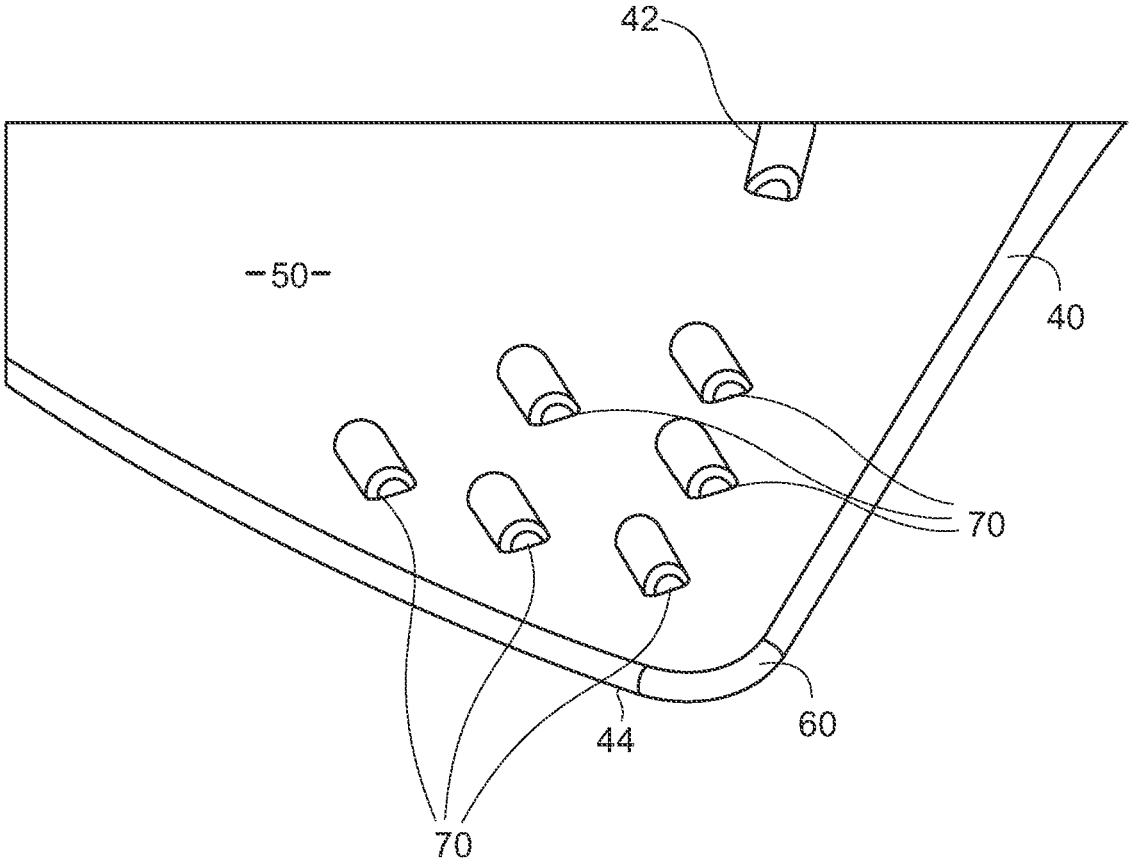
FIG. 7 is an enlarged view of the silencer seeds positioned on the suction side of the blade of the propeller fan.

Turning now to FIG. 7, and with continuing reference to FIG. 6, a plurality of protrusions or silencer seeds 70 are configured on the suction side 50 proximate the leading edge 60 of at least one of the plurality of blades 40. The silencer seeds 70 lower sound pressure levels generated during operation of the propeller fan 14. In one embodiment of the invention, the silencer seeds 70 are situated on the suction side 50 of the blade 40 proximate to the leading edge 60 and at the tip of the blade. The silencer seeds 70 are configured to form an array 72 comprising rows R of protrusions P and having a total number of protrusions $P_T$ and a total number of rows of protrusions $R_T$ wherein the total number of protrusions $P_T$ is equal to $R_T$ plus the number of protrusions in the row $R_{T-1}$. The silencer seeds 70 may be configured in an array 72 forming any shape, including but without limitation, a triangle, a concave quadrilateral, a square, a rectangle, a rhombus, a trapezoid, a crescent, a circle, an oval or a diamond. In one embodiment of the invention, the silencer seeds 70 form a pyramidal array 72 of three rows comprising a one-seed, two-seed and three-seed pattern. It will be appreciated that the array of silencer seeds 70 may comprise more or less than three rows and may also conform to any desired shape. Further, it will be appreciated that the silencer seeds 70 within a row R of the array 72 may not be aligned perfectly linearly within the row R but may be offset with respect to each other within the row R.

Each of the silencer seeds 70 has a shape, and in one embodiment of the invention, the shape of the silencer seeds is uniform for each of the silencer seeds in the array 72, although it will be appreciated that the shape of the silencer seeds 70 may vary and differentiate for each of the plurality of silencer seeds. For example, the shape of each of the plurality of silencer seeds 70 may comprise a segmented cylinder, a horizontal segmented cylinder, a hemisphere, or other segmented geometry. In one embodiment of the invention, each of the plurality of silencer seeds 70 comprises a horizontal segmented cylinder.

Each of the plurality of silencer seeds 70 in the array 72 has a surface area, and each of the silencer seeds in each successive row $R_1$ through $R_T$ of the array increases progressively in surface area from one row to the next from the leading edge 60 to the central hub 54. Thus, the array 72 essentially forms a pyramid or an array of ascending height as the rows $R_T$ of the array extend from the leading edge 60 toward the central hub 54, with the surface area of the silencer seeds increasing with each row. It will be appreciated that the respective surface areas of the silencer seeds 70 within each row $R_T$ of the array 72 may differ, although the surface area of each of the plurality of silencer seeds 70 may be substantially equal within each row $R_T$ of the array 72.

In one embodiment of invention, the silencer seeds comprise a horizontal segmented cylinder configured in a triangular shaped array 70 having three rows of silencer seeds. The first row, $R_1$, comprises a single silencer seed 70 having a surface area of 0.0062 $in^2$ (0.003999992 $mm^2$) and a perimeter of 0.3229 in (8.20166 mm), wherein the total number of protrusions P equals 1. The second row, $R_2$, comprises two silencer seeds 70, each having a surface area of 0.0078 $in^2$ (0.005032248 $mm^2$) and a perimeter of 0.3614 in (9.1796 mm), wherein the total number of protrusions P equals 2. The third row, $R_3$, comprises three silencer seeds 70, each having a surface area of 0.0093 $in^2$ (0.02332 $mm^2$) and a perimeter of 0.3958 $in^2$ (10.0533 mm), wherein the total number of protrusions P equals 3. The increasing surface area of the silencer seeds 70 comprising each row $R_T$ in the array 72 provides a shape of ascending height as the array progresses from the leading edge 60 of the blade 50 toward the central hub 54.

The distances between each of the plurality of silencer seeds 70 in the array 72 may be identical, or the distances may vary. For example, the distance between the each of the plurality of silencer seeds 70 within the same row $R_1$ may be identical (a) with respect to each other in the same row $R_1$ and (b) with respect to the silencer seeds 70 within the subsequent row $R_2$. Alternatively, the distance between the silencer seeds 70 within the same row $R_1$ may differ from the distance between the plurality of silencer seeds 70 in row $R_2$. In one embodiment of the invention, the distance between the silencer seeds 70 in rows $R_1$ and $R_2$ is smaller than the distance between the silencer seeds 70 in rows $R_2$ and $R_3$. In another embodiment of the invention, the silencer seeds 70 are uniformly spaced within the array 72 a substantially uniform distance with respect to each of the silencer seeds 70 within each row R and with respect to each of the silencer seeds 70 within each successive row $R_{1+N}$. In one embodiment of the invention, the distance between each of the silencer seeds 70 within the array 72 is approximately 0.6250 in (15.875 mm).

Figure 8:
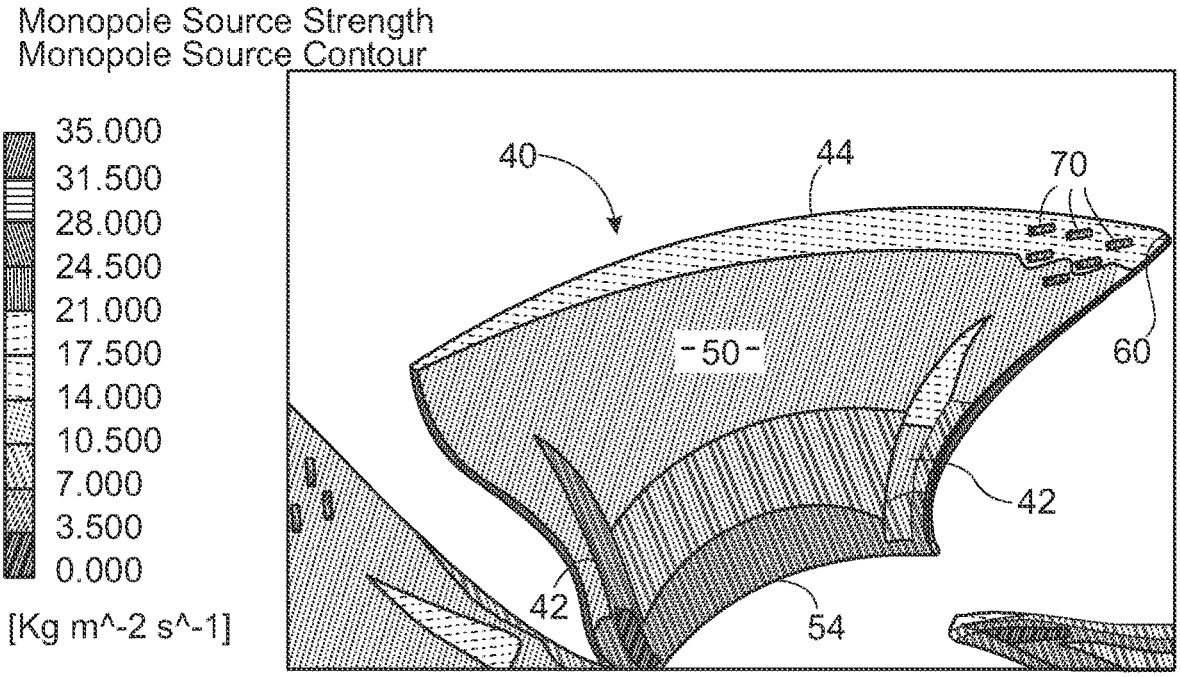
FIG. 8 demonstrates the monopole source strength at the tip of a blade at the silencer seeds and shows that there would be a higher overall monopole source strength and higher sound pressure levels generated by the blade without the silencer seeds.
Figure 9:
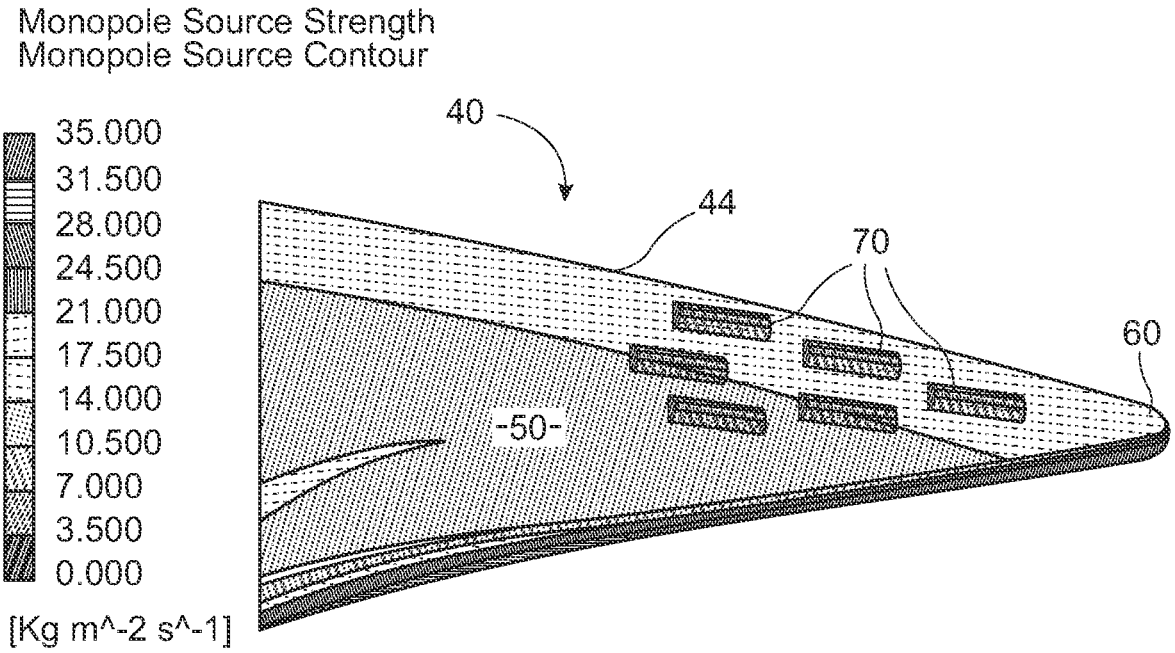
FIG. 9 demonstrates the monopole source strength at the tip of a blade at the silencer seeds and shows that there would be a higher overall monopole source strength and higher sound pressure levels generated by the blade without the silencer seeds.

The effectiveness of the silencer seeds 70 is demonstrated by the monopole source contour illustrated in FIGS. 8 and 9. Monopole sources of sound relate to the movement of the surface of the sources themselves and not due to the wake or any other causes created by the blades 40 as they rotate. Essentially, this is the sound generated by the surfaces of the plurality of blades 40 as they rotate. Dipole sources of sound result from the fluctuation of the fluid pressure of air as the blades 40 rotate. These sound sources are caused by the air as the blades 40 pass through the air.

As shown in FIGS. 8 and 9, the monopole source strength has relatively long streaks, which indicate low monopole source strength in the region of the silencer seeds 70. Without the silencer seeds 70, a higher overall monopole source strength and higher sound pressure levels are generated by the blade 40. The generated sound pressures automatically decrease away from the edge 44 of the blade 40, and particularly away from the leading edge 60, of the blade 40 toward the central hub 54 because there is less airflow closer to the central hub 54 than at the leading edge 60. The placement of the silencer seeds 70 at the leading edge 60 of the blade 40 reduces the sound pressures generated proximal the edge 44 of the blade 40, and particularly proximal the leading edge 60 the blade, since this is the location of more airflow and, thus, more sound in general as that is the more active part of the blade.

Figure 10:
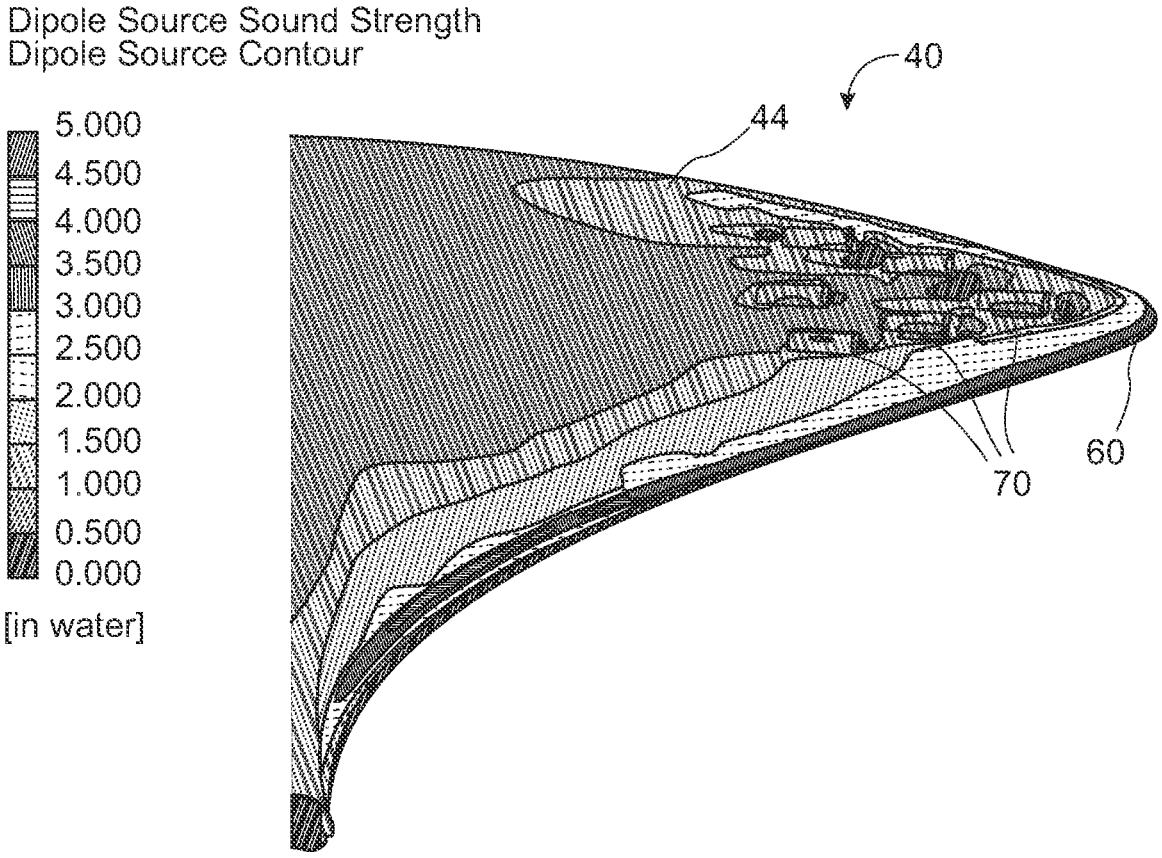
FIG. 10 demonstrates the dipole source strength at the silencer seeds and demonstrates that there would be a higher overall dipole source strength generated by the blade without the silencer seeds.
Figure 11:
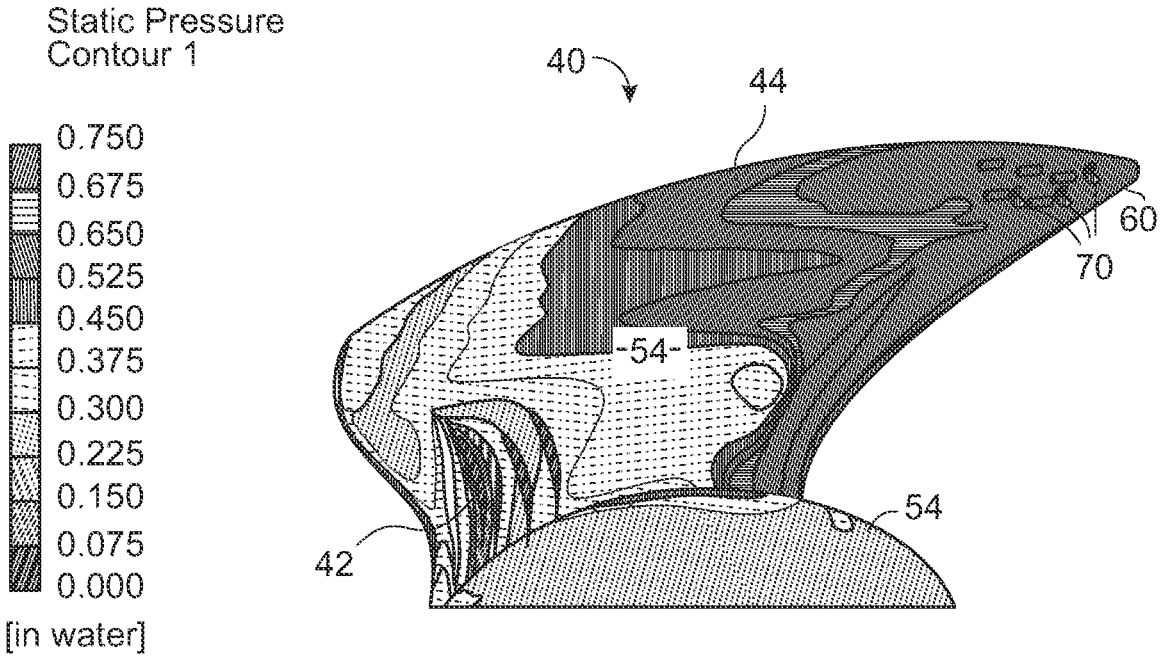
FIG. 11 demonstrates the overall pressure generation across the suction side of the blade and demonstrates that it is only affected minutely.

FIG. 10 demonstrates the dipole source strength, shown in contour with graphic symbols, which indicates low monopole source strength, directly in front of each of the plurality of silencer seeds 70 proximal the leading edge 60. Dipole sources of sound result from the fluctuation of the fluid pressure of air as the blades 40 rotate. Without the silencer seeds 70, there would be a higher overall dipole source strength and higher sound pressure levels generated by the blade 40. Inasmuch as the present invention does not alter the smooth contour of the shape of the blade 40, there is minimal impact to the plurality of blades 40 over pressure generation, as seen FIG. 11, showing static pressure measurements. The overall pressure generation is only affected minutely as indicated by the slight blue streaks proximal the array 72 of silencer seeds 70. This slight change in performance is a small tradeoff compared to the drastic reduction in sound pressure level generation of the blade 40

FIGS. 8 through 11 demonstrate that the silencer seeds 70 create a blocking effect, which are areas where the sound source drops dramatically. Note that, from the leading edge 60 of the blade 40 toward the central hub 54, generated sound pressures decrease, as there is less airflow closer to the hub. The silencer seeds 70 create an obstruction to the otherwise flat airflow path on the suction side 50 of the blade 40 surface. These obstructions assist in preventing larger eddies from forming, which typically drive a significant portion of the overall noise generated by the blade 40. While obstructions are useful in lowering the noise generated by the fan 14, the blockage mechanism must be aerodynamic and smooth. Through CFD studies, it was found that having progressively lower surface area silencer seeds is one means of significantly lowering sound pressure levels while still maintaining desired operating flow points.

Fan manufacturers unanimously attempt to lower sound pressure levels generated by their fans during operation. However, it is seen in the industry that many of the features added to the axial blade design end up also lowering the performance of the fan; in other words, the volumetric flow rate moved by the fan at a particular static pressure is lowered. Thus, the capability of the fan "shrinks" in order to lower the sound pressures generated by the fan blades. Designs that alter the outer contour of the blade, especially those that deviate from a smooth contour in order to lower sound generation, tend also to significantly affect the fan performance negatively. The subject invention is able to lower sound pressure levels without dramatically altering the blade and fan performance.

The fan 14 of the present invention rotates at up to speeds of 1200 RPM, which, without support, may cause the plurality of blades 40 to mechanically undergo forces that potentially deform the shape of the blade and, consequently, alter the performance of the blade from its intended design. If the deformation of the blade 40 during operation of the fan 14 is drastic, the performance of the blade will be impacted and suffer in comparison to the intended design.

Blade deflection is a function of the modulus of elasticity of the material comprising the blade 40 along with the rotational speed. Plastic has a significantly lower modulus of elasticity than that of most metals. Thus, a plastic design will deflect significantly more than an identically shaped metal design at the same speed. Consequently, it is critical to design the plastic fan with features that lower blade deflection during operation to ensure the blade performs as intended.

Figure 12:
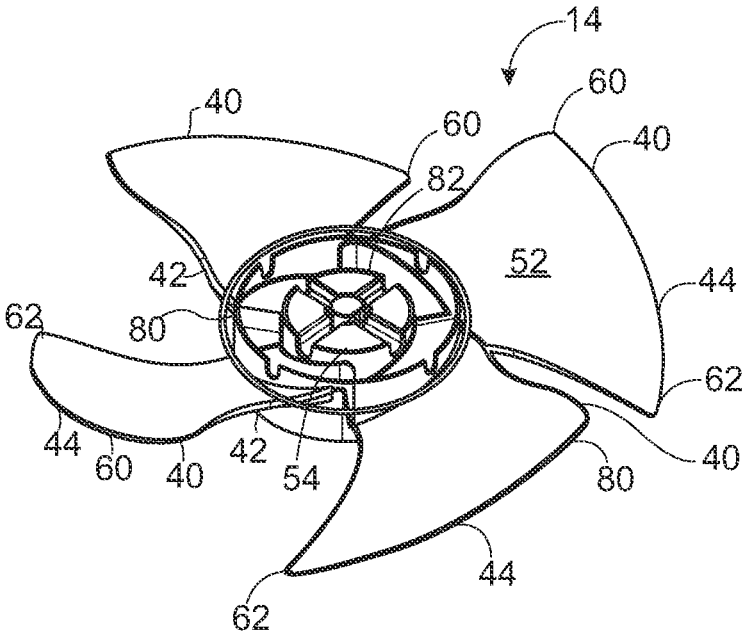
FIG. 12 shows a perspective view of an illustrative central hub having concentric circumferential layers, as viewed from the discharge side, which minimize blade deflection during operation of the fan.
Figure 13:
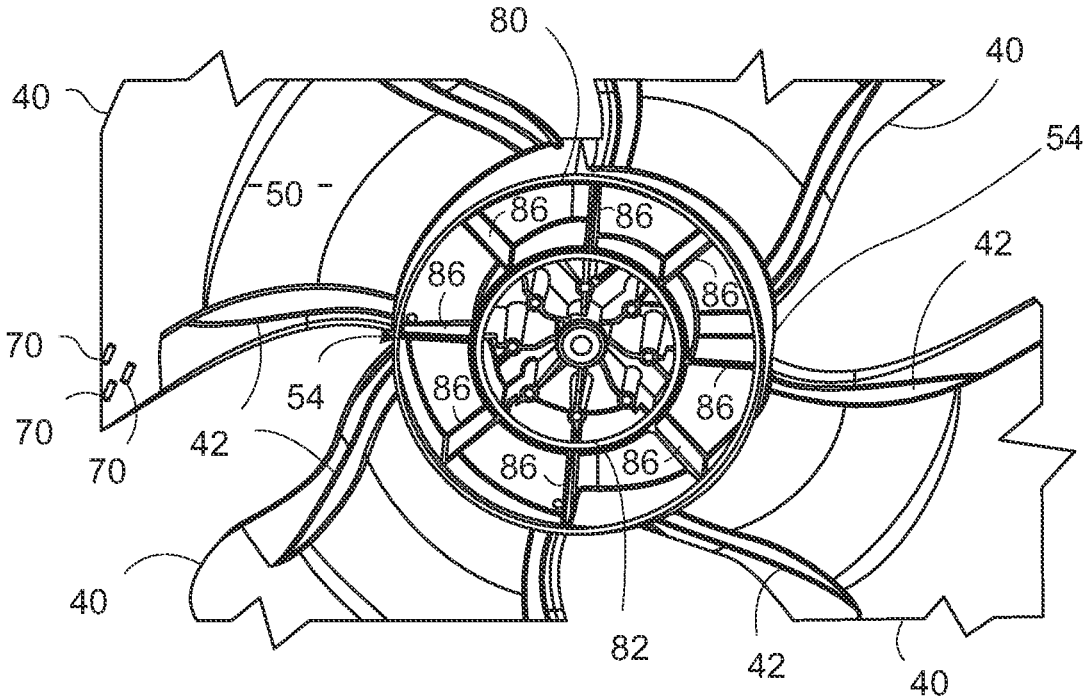
FIG. 13 illustrates a central hub with concentric circumferential layers from the suction side of the fan.

As shown in FIGS. 12 and 13, the central hub 54 of the fan 14 may further comprise concentric circumferential layers 80 and 82 which minimize blade deflection during operation of the fan 14 and preserve performance of the plurality of blades 40 and the overall fan assembly 14. FIG. 12 represents the central hub 54 with concentric circumferential layers 80 and 82 as seen from the discharge side 52, while FIG. 13 represents the central hub 54 with concentric circumferential layers 80 and 82 as seen from the suction side 50. In one embodiment of the invention, the number of concentric circumferential layers is two, 80 and 82, although the number of concentric circumferential layers may be greater than two depending upon the dimensions of the blade 40, the number of blades, the materials from which the blades are made and other factors. The concentric circumferential layers 80 and 82 may be integrally formed with the plurality of blades 40, or may be separately formed and constructed and attached to the blades 40. The concentric circumferential layers 80 and 82 may further comprise connecting ribs 86 therebetween which offer additional strength, rigidity and integrity to the central hub 54 and the plurality of blades 40.

Figure 14:
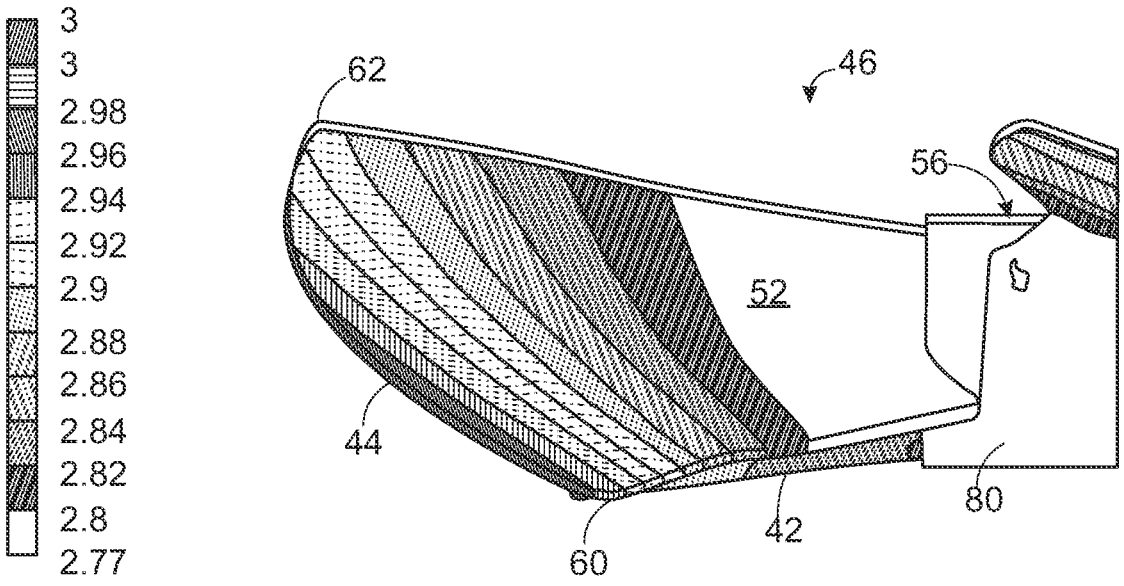
FIG. 14 is a graph depicting the deflection of the blade and shows that there is minimal deflection of the blade during operation.

Tests conducted using finite element-based computer simulations and physical verifications of models show that a plastic fan with two concentric, circumferential layers 80 and 82 provides significant additional support to the plurality of blades 40 during operation of the fan 14 and preserve the performance of the blades 40. As shown in FIG. 14, the overall blade 40 deflection during operation was quantifiable. Without the dual layered hub, the maximum deflection was approximately 10 mm. The inclusion of the two concentric circumferential layers 80 reduced deflection by 70, as shown in FIG. 14. The greyed-out portion overlapping represents the undeflected blade shape.

Through advanced finite element-based computer simulations and physical verifications of models, it was found that a plastic fan that has two circumferential layers provided significant additional support to the blades during operation. This allowed to minimize blade deflection and preserve the performance of the blade as it was intended. By conducting finite element analyses on the blade design, the overall blade deflection during operation was quantifiable. Without the dual layered hub, the maximum deflection was approximately 10 mm. With this feature, this value is reduced by 70% as seen below. The greyed-out portion overlapping is the undeflected blade shape.

The method and operation of the invention will now be explained. The foregoing description of the invention is incorporated herein. The invention comprises a method of lowering sound pressure generation during operation of a heating ventilation and air conditioning refrigeration system comprising a propeller fan having blades, the method comprising the step of reducing dipole source strength as air passes over the blades during operation of the fan. The method further comprises the step of reducing dipole source strength further comprises the step of providing a plurality of protrusions at a leading edge of a suction side of at least one of the blades. The method further comprising the step of arranging the plurality of protrusions in an array comprising a plurality of rows. The method further comprises the step of increasing the surface area of the plurality of protrusions in each successive row comprising the plurality of rows. The method further comprises the step of arranging the plurality of protrusions in a pyramidal array.

The invention comprises a method of reducing deflection of blades of a propeller fan having a plurality of blades, the method comprising the step of configuring the plurality of blades in a concentric configuration around a central hub wherein the central hub comprises at least two circumferential layers. The method may further comprise the step of providing a connecting rib between the two circumferential layers. The method may further comprise the step of providing circumferential layers of the central hub in a concentric arrangement.

The present invention allows modularity of the fan components and offers benefits related thereto. The type and size of the motor for use with the propeller fan assembly of the present invention can be altered according to the application, to meet changing conditions and requirements or for convenience during maintenance. An illustrative example of a method for assembling the propeller fan 14 is provided. To assemble a one HP condenser fan, with annual usage of approximately 28000 hours across rooftop unit products, the following components or equivalents are may be used:

G082710 Fan 34|2500/month

G082720 Motor Connection Component 100)|2500/month

G071860 Grill 32|2500/month1 HP motor 34 (any one of the following per the BOM: G078120, G078121, G078122, G078123, G078130, G078131, G078132, G078133)|2500/month G081480 (setscrew to connect the hub 54 to the motor shaft 43)|2500/month P27450 (nut to connect the motor 34 to the mount plate 104)|10000/month G081490 (washer to connect the motor 34 to the mount plate 104)|10000/month G081470 (plastic-specialized screws to connect the grill 32 to the mounting orifice 38)|10000/month P52710 (self-tapping screw to connect the mounting orifice 38 to the base sheet metal)|20000/month204-980-001 will also be used, but it is a tool made out of sheet metal that can be used repeatedly through many assemblies and is not a part of the assembly.

The mounting plate 104 comes with four push pins to hold the motor connection component 100 together. These pins should not be removed at any point. The mounting plate 104 has been created to accommodate these pins. Place the motor connection component 100 such that the four push pins align with and go through the four slots 108 on the mounting plate 104. On the outer holes of the motor connection component, use a drill to fasten screws with a minimum torque of 61 in-lbs. Ensure that the screws have gone all the way and there is a tight fit between the motor mount component 100 and mounting plate 104. Place the motor 34 under the motor mount component 100 and have the four motor throughbolts go through four slots 108 in the mounting plate 104. Add four washers to the motor throughbolts now. Add four nuts on top of the washers (one nut per washer) and tighten the nuts to a maximum torque of 9 in-lb2. Ensure there is a tight fit between the nuts and the mounting plate 104. Using a tool as a set-handle, rotate the motor shaft 43 until the flat part of the motor shaft is in line with the fan setscrew hole. Once the fan setscrew hole and the motor flat are in line, drop the blades 40 on the motor shaft 43 and let them slide down as far as it will go, until the motor shaft head stops the fan. Ensure the fan setscrew hole is in line with the motor shaft flat. Add the setscrew to the fan insert, ensuring that it is setting on the motor shaft flat and tighten the setscrew until it reaches 65 in-lbs. Give the fan a quick spin by hand and visually ensure the fan is rotating with the motor shaft. Place the grill 32 on top of this assembly. The horizontal rods must be under the spiral rods. Using four plastic-special screws, tighten all four holes to a torque of 20 in-lb. Ensure the grill 32 has a tight fit with the orifice. The invention employs a unique assembly method that allows for wide flexibility and permits use of motors 40 of different types and sizes seamlessly with this propeller fan assembly 36.

It now will be appreciated that the present invention reduces sound generation, without limiting fan performance, through the provision of silencer seeds, strategically arrayed, shaped and sized, on the suction side proximate the leading edge of at least one blade of the fan. The invention also presents a mounting assembly for mounting the fan blades to the motor, which enables the use and interchange of a variety of sizes and types of motors with the invention. Further, the present invention minimizes blade deflection and preserves the performance of the blade as it was intended. Circumferential, concentric layers at a central hub provide significant additional support to the blades during operation and minimize blade deflection.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A propeller fan for a heating, ventilation and air conditioning (HVAC) unit, the propeller fan comprising:

a plurality of blades arranged in a concentric configuration, each of the plurality of blades comprising a leading edge, trailing edge, a suction side and a discharge side; and a plurality of protrusions P configured on the suction side proximate the leading edge of at least one of the plurality of blades;

wherein the plurality of protrusions lowers sound pressure levels generated during operation of the propeller fan.

2. The propeller fan of claim 1:

wherein the plurality of protrusions are configured to form an array comprising rows R of protrusions P and having a total number of protrusions $P_T$ and a total number of rows of protrusions $R_T$, and wherein the total number of protrusions $P_T$ is equal to $R_T$ plus the number of protrusions in the row $R_{T-1}$.

3. The propeller fan of claim 1 wherein the plurality of protrusions P are configured in an array forming a triangle, a concave quadrilateral, a square, a rectangle, a rhombus, a trapezoid, a crescent or a diamond.

4. The propeller fan of claim 1 wherein each of the plurality of protrusions P has a surface area and each of the plurality of protrusions in each successive row $R_1$ through $R_T$ increases in surface area.

5. The propeller fan of claim 4 wherein in the surface area of each of the plurality of protrusions P within each successive row $R_1$ through $R_T$ increases.

6. The propeller fan of claim 1 wherein each of the plurality of protrusions P form a horizontal segmented cylinder.

7. The propeller fan of claim 1 wherein each of the plurality of protrusions P has a shape selected from the group consisting of segmented cylinder or horizontal segmented cylinder.

8. The propeller fan of claim 1 further comprising a mounting assembly, the mounting assembly comprising:

a sidewall;

an inner ring forming a central annulus; and a plurality of spokes extending between the sidewall and the inner ring.

9. The propeller fan of claim 8 wherein the number of the plurality of spokes are eight.

10. The propeller fan of claim 8 further comprising:

a motor connection forming a central aperture and positioned atop the inner ring; and a plate positioned above the motor connection, the plate forming a central aperture;

wherein, when in assembled configuration, the central aperture of the plate aligns with the central aperture of the motor connection for receiving a motor.

11. The propeller fan of claim 10, wherein the plate has an exterior edge and a thickness and forms a plurality of slots positioned between the exterior edge and the central annulus of the plate through the thickness of the plate, the slots being adapted to connect to motors of varying sizes and types.

12. The propeller fan of claim 10 wherein the plate is made of metal.

13. A method of lowering sound pressure generation during operation of a heating ventilation and air conditioning system comprising a propeller fan having blades, the method comprising the steps of reducing dipole source strength as air passes over the blades during operation of the fan by providing a plurality of protrusions at a leading edge of a suction side of at least one of the blades.

14. The method of claim 13 further comprising the step of arranging the plurality of protrusions in an array comprising a plurality of rows wherein the plurality of protrusions are configured to form an array comprising rows R of protrusions P and having a total number of protrusions $P_T$ and a total number of rows of protrusions $R_T$; and wherein the total number of protrusions $P_T$ is equal to $R_T$ plus the number of protrusions in the row $R_{T-1}$.

15. The method of claim 13 wherein each of the plurality of protrusions P has a surface area and further comprising the step of increasing the surface area of the plurality of protrusions in each successive row comprising the plurality of rows.

16. The method of claim 14 further comprising the step of arranging the plurality of protrusions in a pyramidal array.

17. A propeller fan for a heating, ventilation and refrigeration unit, the propeller fan comprising:

a plurality blades arranged in a concentric configuration around a central hub wherein the central hub comprises at least two circumferential layers and at least one connecting rib between the two circumferential layers.

18. The propeller fan of claim 17 wherein the circumferential layers are integrally formed with the plurality of blades.

19. The propeller fan of claim 18 wherein the two circumferential layers are concentric.

20. The propeller fan of claim 17 wherein the blades comprise ribs formed along a portion or all of the length to assist in preventing deflection of the blade.

21. A method of reducing deflection of blades of a propeller fan having a plurality of blades, the method comprising the steps of configuring the plurality of blades in a concentric configuration around a central hub wherein the central hub comprises at least two circumferential layers and providing a connecting rib between the two circumferential layers.

22. The method of claim 21 wherein the circumferential layers of the central hub are concentric.

23. A modular mounting assembly for attaching different motor types and sizes to a propeller fan, the modular mounting assembly comprising:

a sidewall;

an inner ring forming a central annulus;

a plurality of spokes extending between the sidewall and the inner ring;

a motor connection forming a central aperture and positioned atop the inner ring; and a plate positioned above the motor connection, the plate forming a central aperture;

wherein, when in assembled configuration, the central aperture of the plate aligns with the central aperture of the motor connection for receiving a motor.

24. The modular mounting assembly of claim 23 wherein the number of the plurality of spokes are eight.

25. The modular mounting assembly of claim 23, wherein the plate has an exterior edge and a thickness and forms a plurality of slots positioned between the exterior edge and the central annulus of the plate through the thickness of the plate, the slots being adapted to connect to motors of varying sizes and types.

26. The modular mounting assembly of claim 23 wherein the plate is made of metal.

27. A heating, ventilation and air conditioning (HVAC) unit comprising:

a propeller fan comprising:

a plurality of blades arranged in a concentric configuration, each of the plurality of blades comprising a leading edge, trailing edge, a suction side and a discharge side; and a plurality of protrusions P configured on the suction side proximate the leading edge of at least one of the plurality of blades;

wherein the plurality of protrusions lowers sound pressure levels generated during operation of the propeller fan.

28. The HVAC unit of claim 27:

wherein the plurality of protrusions are configured to form an array comprising rows R of protrusions P and having a total number of protrusions $P_T$ and a total number of rows of protrusions $R_T$, and wherein the total number of protrusions $P_T$ is equal to $R_T$ plus the number of protrusions in the row $R_{T-1}$.

29. The HVAC unit of claim 28 wherein the plurality of protrusions are configured in an array forming a triangle, a concave quadrilateral, a square, a rectangle, a rhombus, a trapezoid, a crescent or a diamond.

30. The HVAC unit of claim 28 wherein each of the plurality of protrusions has a surface area and each of the plurality of protrusions in each successive row $R_1$ through $R_T$ increases in surface area.

31. The HVAC unit of claim 28 wherein in the surface area of each of the plurality of protrusions P within each successive row $R_1$ through $R_T$ increases.

32. The HVAC unit of claim 27 wherein each of the plurality of protrusions form a horizontal segmented cylinder.

33. The HVAC unit of claim 27 wherein each of the plurality of protrusions has a shape selected from the group consisting of segmented cylinder or horizontal segmented cylinder.

34. The HVAC unit of claim 27 further comprising a mounting assembly, the mounting assembly comprising:

a sidewall;

an inner ring forming a central annulus; and a plurality of spokes extending between the sidewall and the inner ring.

35. The propeller fan of claim 34 wherein the number of the plurality of spokes are eight.

36. The propeller fan of claim 34 further comprising:

a motor connection forming a central aperture and positioned atop the inner ring; and a plate positioned above the motor connection, the plate forming a central aperture;

wherein, when in assembled configuration, the central aperture of the plate aligns with the central aperture of the motor connection for receiving a motor.

37. The propeller fan of claim 36, wherein the plate has an exterior edge and a thickness and forms a plurality of slots positioned between the exterior edge and the central annulus of the plate through the thickness of the plate, the slots being adapted to connect to motors of varying sizes and types.

38. The propeller fan of claim 35 wherein the plate is made of metal.

39. A method of assembling a propeller fan having a plurality of blades and adapted to receive modular motors for a heating, ventilation and air conditioning unit, the method comprising the steps of:

providing a mounting plate having a plurality of slots and a central annulus, the slots being adapted to connect to motors of varying sizes and types;

supplying a motor connection component beneath the mounting plate, the motor connection component forming a central aperture;

positioning the motor connection component in alignment with the central annulus of the mounting plate for receiving a modular motor having a motor shaft; and securing a plurality of blades to the mounting plate.

40. The method of claim 39 further comprising the steps of:

placing the modular motor under the motor connection component; and aligning the plurality of blades with the motor shaft of the modular motor and rotating the motor shaft until the plurality of blades are aligned on the motor shaft as far as they will go.

41. The method of claim 40 further comprising the step of securing the modular motor to the mounting plate through the motor connection component and the plurality of slots in the mounting plate.

* * * * *